United States Patent [19]

Efner

[11] 4,335,004

[45] Jun. 15, 1982

[54] LUBRICATING COMPOSITIONS CONTAINING DIESTERS OF DIMERCAPTO ETHERS

[75] Inventor: Howard F. Efner, Bartlesville, Okla.

[73] Assignee: Phillips Petroleum Company, Bartlesville, Okla.

[21] Appl. No.: 111,414

[22] Filed: Jan. 11, 1980

[51] Int. Cl.[3] ..... C10M 1/38

[52] U.S. Cl. ..... 252/48.6

[58] Field of Search ..... 252/48.6, 52 A, 56 R

[56] References Cited

U.S. PATENT DOCUMENTS

| | | | |
|---|---|---|---|
| 2,540,570 | 2/1951 | Cyphers | 252/48.6 X |
| 2,585,862 | 2/1952 | Smith, Jr. et al. | 252/48.6 X |
| 2,603,604 | 7/1952 | Ballard et al. | 252/48.6 |
| 2,614,982 | 10/1952 | Caldwell et al. | 252/48.6 X |
| 3,189,547 | 6/1965 | Calhoun | 252/48.6 |
| 3,198,737 | 8/1965 | Calhoun | 252/48.6 |
| 3,278,434 | 10/1966 | Hoffman | 252/48.6 |
| 3,314,888 | 4/1967 | Matson | 252/48.6 |
| 3,526,596 | 9/1970 | Kress et al. | 252/52 A X |
| 3,817,971 | 6/1974 | Carlson et al. | 252/48.6 X |
| 3,920,562 | 11/1975 | Foehr | 252/33.4 X |
| 3,933,659 | 1/1976 | Lyle et al. | 252/515 A X |
| 3,991,089 | 11/1976 | Schwab et al. | 252/48.6 X |

*Primary Examiner*—Andrew Metz

[57] ABSTRACT

Lubricating compositions exhibiting lower coefficient of friction are provided comprising a mineral lubricating oil containing an effective amount of at least one diester formed from a diol (dithiol) and a saturated fatty acid.

8 Claims, No Drawings

LUBRICATING COMPOSITIONS CONTAINING DIESTERS OF DIMERCAPTO ETHERS

This invention relates to improved lubricants and process of preparing the same. In accordance with another aspect, this invention relates to the use of esters of diols as lubricant friction modifiers. In accordance with another aspect, this invention relates to lubricating oils having reduced or lower coefficient of friction having incorporated therein a small quantity of a diester.

The present invention provides an additive for lubricating oils that will lower the coefficient of friction, thereby providing a more desirable lubricant for commercial applications.

Accordingly, an object of this invention is to improve lubricating oils.

Another object of this invention is to improve lubricating oils by adding specific additives thereto to lower the coefficient of friction.

A further object of this invention is to provide new and improved mineral lubricating oils and methods of preparing the same.

Other aspects, objects, and the several advantages of this invention will be apparent to those skilled in the art upon further study of the specification and appended claims.

In accordance with the invention, lubricating oils exhibiting lower coefficient of friction are produced by addition of minor amounts of esters of diols to the oil.

In accordance with one embodiment of the invention, diesters formed from diols and saturated fatty acids are used as additives for mineral lubricating oils to reduce the coefficient of friction of the lubricating composition.

The additive of the invention is a diester having the general formula $RCOX(CH_2)_nX'_m(CH_2)_nXCOR'$ where X and X' are selected independently from the group oxygen and sulfur, R and R' are hydrocarbyl radicals having from 7 to 25 carbon atoms, n can have values between 1–6 and the radicals need not be identical, and m can be either one or two when X' is sulfur but only one when X' is oxygen. The hydrocarbyl groups are alkyl radicals that can be either normal or branched. These groups can also contain naphthenic or aromatic rings that are not connected directly to the carbonyl carbon. Examples of suitable hydrocarbyl radicals are n-heptyl, 2-ethylhexyl, n-decyl, n-dodecyl, 14-methylpentadecyl, n-heptadecyl, cyclohexylmethyl, 2-cyclohexylpentyl, benzyl, 17-phenylheptadecyl, and the like.

Diols (dithiols) that are suitable for use in the preparation of these compounds have the structure, as can be inferred from the general formula above, $HX(CH_2)_nX'_m(CH_2)_nXH$ where X, X', n, and m have the same meaning as given above. Suitable examples are 2,2'-thiodiethanol $(HOCH_2CH_2)_2S$, 2,2,'-dimercaptodiethyl ether $(HSCH_2CH_2)_2O$, and diethylene glycol $(HOCH_2CH_2)_2O$.

The saturated fatty acids suitable for use in the preparation of the diester additives are acids having from 8 to 26 carbon atoms. Suitable examples are caprylic, capric, lauric, myristic, palmitic, stearic, and the like. If desired, mixtures of the acids as well as the diols can be used in preparing the diester additives.

These diesters are prepared by reaction of two moles of appropriate carboxylic acids per mole of appropriate diol (dithiol) under conditions that permit the esterification reaction. Since water is a product of this reversible reaction, esterification conditions are designed to remove water as it is made in the reaction. A convenient way to effect the esterification is a batch process in which the reactants are combined and heated under a flowing blanket of a dry gas that carries away water vapor as it is formed. Alternatively, the reaction can be effected in a hydrocarbon solvent maintained at reflux temperature and under conditions that water is condensed and separated from the refluxing solvent. Suitable solvents are aliphatic and aromatic hydrocarbons having normal boiling points in the temperature range indicated below. Examples of suitable solvents are toluene, the xylenes, any of the isomeric nonanes, decanes, undecanes or mixtures of them.

The temperature for the esterification reaction can range between about 50°–250° C. Preferably to attain a reasonably rapid yet controllable rate a temperature in the range 125°–200° C. is used.

Although esterification proceeds in the absence of an added catalyst, it is preferred to have a small concentration of a strong acid present. Sulfuric acid or hydrocarbylsulfonic acids such as p-toluenesulfonic acid are suitable for use. Their concentration in the reaction preferably will not exceed one weight percent, and it can be as low as 0.005 weight percent.

Upon completion of esterification, as indicated by cessation of water formation, the diester can be combined with the lubricant in which it will serve as an additive. Solvent, if used, can optionally be separated from the diester by distillation. Strong acid catalyst, if used and in an undesirably high concentration for the product, can be removed by washing the diester with water and discarding the aqueous phase.

LUBE OIL

The lubricant composition into which the present friction modifying additives can be formulated can be any such lubricating composition in which reduction of the coefficient of friction is desirable. Thus, such compositions can include motor oils, greases, automatic transmission oils, cutting oils, hydraulic fluids, and the like. The present invention additives are found to be particularly suitable for incorporation into motor oil.

These lubricating compositions are based on mineral oils such as those of petroleum origin and are preferably refined oils produced by well-known refining processes employing techniques such as hydrogenation, polymerization, dewaxing, solvent extraction, etc. These oils generally have a Saybolt viscosity at 100° F. in a range of about 60 to about 5000 and a Saybolt viscosity at 210° F. of from about 30 to 250. Mineral oils can be paraffinic, naphthenic, or aromatic, or mixtures of these.

When such lubricants are in the form of a grease, the lubricant composition will contain a suitable grease thickener such as a lithium soap or a hydrocarbon polymer. Such grease compositions are well-known in the art and they are generally prepared by dissolving soaps and/or polymers in the oil at elevated temperatures.

In addition to the friction modifying additive, the lubricating composition can contain other conventional components such as antioxidants, viscosity index improvers, pour point depressants, antifoam agents, anticorrosion agents, and the like.

The concentration of diester suitable for use as a friction modifying additive in lubricating oil will vary according to the nature of the lubricant and the specific lubricating application and generally can range between about 0.1 to 25 weight percent, based on the weight of the mixture. The amount of lubricating oil additive will be a small, but effective, amount sufficient to impart lower coefficient of friction of the lubricating oil and this amount can vary appreciably depending upon the particular diester additive as well as the particular mineral lubricating oil being used.

A suitable procedure for evaluating and comparing friction modifying lubricant additives is to use a Falex wear-testing machine following the procedure of ASTM D2670-67 modified as described in ASLE Transactions 19, 335-6 (1976). This test procedure consists of running a rotating journal against two stationary steel V-blocks immersed in the lubricant sample. Load is applied to the V-blocks and maintained by a ratchet mechanism. Wear is determined and recorded as the number of teeth of ratchet mechanism advanced to maintain the load constant during the prescribed testing time. The coefficient of friction f, a quantity also obtained during the wear test, is a dimensionless number that is proportional to the frictional force observed in the test. It is directly proportional to the torque on the test specimen and inversely proportional to the load. Specific conditions for the Falex test machine used in the instant invention consisted of a 0.5 hour break-in at an applied load of 23 kg followed by three hours of testing at 118 kg. The lubricant, pin, and V-blocks were heated to 79.5° C. during break-in. Temperature was not controlled during the test; it increased or decreased depending on the amount of frictional heat produced.

Preparation of diesters that conform to the description of the instant invention as well as similar diesters that are not a part of the invention, and results of tests with them on the Falex machine are presented in the following examples.

EXAMPLE I

Diester A was prepared by reaction between 1672 g (8 moles) of distilled coco acids (Armak Neo-fat 265) and 488 g (4 moles) of 2,2'-thiodiethanol, dissolved in 500 mL of toluene containing 2 g of p-toluenesulfonic acid monohydrate. The mixture, in a 5 liter flask fitted with a reflux condenser and a Barrett trap, was heated at reflux for 5.5 hours; the flask temperature increased from 129 to 152° C. during that interval, and 89.6% of the stoichiometric quantity (8 moles) of water was removed. Toluene was removed from the product by warming to about 80° C. in a rotary evaporator at subatmospheric pressure.

EXAMPLE II

Diester B was prepared by reaction between 209 g (1 mole) of distilled coco acids and 69.1 g (0.5 mole) of 2,2'-dimercaptodiethyl ether, dissolved in 60 mL of toluene containing about 0.5 g of p-toluenesulfonic acid monohydrate. The mixture was refluxed in a ½-liter flask fitted as in Example I. During 8 hours 69% of the stoichiometric quantity of water was removed. Toluene was removed as in Example I.

EXAMPLE III

Diester C was prepared by reaction between 410 g (2 moles) of distilled coco acids and 106 g (1 mole) of diethylene glycol, dissolved in 75 mL of toluene containing about 1 g of p-toluenesulfonic acid monohydrate. The mixture was refluxed in a 1-liter flask fitted as in Example I. The stoichiometric quantity of water was removed in 1.7 hours. Toluene was removed as in Example I.

EXAMPLE IV

Diester D was prepared by reaction between 139 g (0.5 moles) of isopalmitic acid (Fallek Chem. Corp.) and 30.5 g (0.25 moles) of 2,2'-thiodiethanol, dissolved in 60 mL of toluene containing two drops of concentrated sulfuric acid. In six hours at reflux temperature 67% of the stoichiometric quantity of water was removed. Toluene was removed as in Example I.

EXAMPLE V

Diester E was prepared by reaction between 284.5 g (1 mole) of stearic acid and 59 g (0.48 mole) of 2,2'-thiodiethanol, dissolved in 200 mL toluene containing about 0.5 g p-toluenesulfonic acid. The mixture was refluxed in a 1-liter flask fitted as in Example I; the temperature in the flask was 133°-4° C. Evolution of water ceased after three hours; in that time 81% of the stoichiometric quantity of water was removed. Toluene was removed as in Example I.

EXAMPLE VI

Diester F was prepared by reaction between 54.5 g (0.26 mole) of n-octylthioacetic acid (n-$C_8H_{17}SCH_2COOH$) with 15.5 g (0.125 mole) of 2,2'-thiodiethanol, dissolved in 200 mL toluene containing about 0.5 g p-toluenesulfonic acid monohydrate. In 4.5 hours at reflux temperature 75% of the stoichiometric quantity of water was removed. Toluene was removed as in Example I. Diester F is not considered to be part of this invention.

EXAMPLE VII

Diester G was prepared by reaction between 205 g (1 mole) of distilled coco acids and 52 g (0.5 moles) of 1,5-pentanediol, dissolved in 50 mL toluene containing two drops of concentrated sulfuric acid. The mixture was refluxed in a ½-liter flask fitted as in Example I. In 2.5 hours the stoichiometric quantity of water was removed. Toluene was removed as in Example I. Diester G is not considered to be part of this invention.

EXAMPLE VIII

Diester H was prepared by reaction between 89.0 g (0.5 mole) of thiodipropionic acid [$S(CH_2CH_2COOH)_2$] and 158.3 g (1.0 mole) of n-decyl alcohol, dissolved in 60 mL of toluene containing 0.5 g of p-toluenesulfonic acid monohydrate. The mixture was refluxed in a ½-liter flask fitted as in Example I. In 1.5 hours 92% of the stoichiometric quantity of water was removed. Toluene was removed as in Example I. This diester is a product of an alcohol with a dibasic acid and is not considered to be part of this invention.

EXAMPLE IX

Diester J was prepared by reaction between 52.5 g (0.25 moles) of dithiodipropionic acid $S_2(CH_2CH_2COOH)_2$ and 79 g (0.50 moles) n-decyl alcohol, dissolved in 60 mL of toluene containing about 0.5 g p-toluenesulfonic acid monohydrate. The mixture was refluxed in a ½-liter flask fitted as in Example I. In two hours 94% of the stoichiometric quantity of water was removed. Toluene was removed as in Example I. This diester is not considered to be part of this invention.

EXAMPLE X

Diester K was prepared by reaction between 44.5 g (0.25 mole) of thiodipropionic acid and 65 g (0.5 mole) of n-octyl alcohol, dissolved in 60 mL of toluene containing about 0.5 g of p-toluenesulfonic acid monohydrate. The mixture was refluxed in a ½-liter flask fitted as in Example I. In two hours 97% of the stoichiometric quantity of water was removed. Toluene was removed as in Example I. This diester is not considered to be part of this invention.

EXAMPLE XI

The diesters whose preparation is described in Examples I-X were tested in a Falex machine. They were used as additives in two different oils: (1) Sontex white mineral oil, (2) a fully formulated SE motor oil. Results of these tests are presented in Table I. Unless otherwise stated, their concentration in the oil being tested was two weight percent. Most tests were run in duplicate and the results of both tests are given in Table I; a single value indicates only a single test.

TABLE I

| | Mineral Oil | | Motor Oil | |
|---|---|---|---|---|
| Diester | Wear, Teeth | f | Wear, Teeth | f |
| A | 54, 56 | 0.082, 0.085 | 9, 19 | 0.079, 0.087 |
| A (0.5 wt. %) | | | 10, 14 | 0.110, 0.112 |
| A (1.0 wt. %) | | | 4, 8 | 0.094, 0.096 |
| A (1.5 wt. %) | | | 6, 18 | 0.093, 0.095 |
| B | 28, 33 | 0.082, 0.086 | 21 | 0.087 |
| C | 60, 67 | 0.086, 0.090 | 2, 10 | 0.096, 0.098 |
| D | 20, fail | 0.092 | 17, 49 | 0.093, 0.099 |
| E | 55, 57 | 0.082, 0.083 | | |
| F | | | 11, 13 | 0.086, 0.107 |
| G | Failed on Loading | | | |
| H | 44, 56 | 0.088, 0.092 | 0, 0 | 0.110, 0.114 |
| J | 7, 22 | 0.092, 0.104 | 16 | 0.132 |
| K | 0, 0 | 0.095, 0.103 | 8 | 0.117 |
| None | Failing on Loading | | 0 | 0.112 |

Diesters A, B, C, D, and E, which are examples of the instant invention, reduced the coefficient of friction in motor oil when compared to the untreated oil, and obviously improve the white mineral oil, which fails the Falex test on loading.

Diesters F and G resemble the general formula for compounds of this invention but differ in certain details.

Diesters H, J, and K did not decrease f in motor oil, although they were close to it. They differ from the inventive compounds by being diesters of a dicarboxylic acid rather than a diol.

I claim:

1. A lubricating oil composition comprising a major proportion of a mineral lubricating oil containing a small, but effective, amount, sufficient to impart lower coefficient of friction, of a diester having the general formula $RCOS(CH_2)_nO(CH_2)_nSCOR'$ where R and R' are alkyl radicals having from 7 to 25 carbon atoms, n can have values between 1–6 and the radicals need not be identical.

2. A composition according to claim 1 wherein the amount of diester present ranges from about 0.1 to about 25 weight percent of the composition.

3. A composition according to claim 1 wherein the lubricating oil has a Saybolt viscosity at 210° F. of from about 30 to about 250.

4. A composition according to claim 1 wherein said diester is formed by the reaction between coco acids and 2,2'-dimercaptodiethyl ether.

5. A method for reducing the coefficient of friction of mineral lubricating oils which comprises incorporating therein a small, but effective, amount sufficient to lower the coefficient of friction of a diester having the general formula $RCOS(CH_2)_nO(CH_2)_nSCOR'$ where R and R' are alkyl radicals having from 7 to 25 carbon atoms, n can have values between 1–6 and the radicals need not be identical.

6. A process according to claim 5 wherein the amount of said diester added to said mineral lubricating oil ranges from about 0.1 to about 25 weight percent of the composition.

7. A method according to claim 5 wherein the lubricating oil has a Saybolt viscosity at 210° F. of from about 30 to about 250.

8. A method according to claim 5 wherein said diester is formed by the reaction between coco acids and 2,2'-dimercaptodiethyl ether.

* * * * *